US012667927B2

(12) United States Patent
Dong

(10) Patent No.: US 12,667,927 B2
(45) Date of Patent: Jun. 30, 2026

(54) ELECTRIC KNIFE SHARPENER FOR ELASTICALLY GRINDING DOUBLE EDGES

(71) Applicant: Newness Ongoing Technology Co., Limited, Hong Kong (CN)

(72) Inventor: Qiulei Dong, Zhongshan (CN)

(73) Assignee: Newness Ongoing Technology Co., Limited, Hong Kong (CN)

( * ) Notice: Subject to any disclaimer, the term of this patent is extended or adjusted under 35 U.S.C. 154(b) by 405 days.

(21) Appl. No.: 18/475,998

(22) Filed: Sep. 27, 2023

(65) Prior Publication Data

US 2025/0100098 A1 Mar. 27, 2025

(51) Int. Cl.
*B24B 3/54* (2006.01)

(52) U.S. Cl.
CPC ..... *B24B 3/54* (2013.01)

(58) Field of Classification Search
CPC .. B24B 3/52; B24B 3/54; B24B 3/543; B24D 15/08; B24D 15/081; B24D 15/082
See application file for complete search history.

(56) References Cited

U.S. PATENT DOCUMENTS 2,114,106 A * 4/1938 Geveke ..... B24B 3/54 451/486
4,723,375 A * 2/1988 Linden ..... B24D 15/082 451/241
6,012,971 A * 1/2000 Friel, Sr. ..... B24B 33/081 51/298
6,435,951 B1 * 8/2002 Ishizaka ..... B24B 3/54 451/260
10,850,361 B1 * 12/2020 Dovel ..... B24D 15/081
2003/0077990 A1 * 4/2003 Li ..... B24B 3/54 451/45
2007/0077872 A1 * 4/2007 Elek ..... B24B 3/54 451/359
2008/0261494 A1 * 10/2008 Friel ..... B24B 3/54 76/82
2009/0233530 A1 * 9/2009 Friel, Sr. ..... B24D 15/06 451/65
2011/0034111 A1 * 2/2011 Elek ..... B24B 3/54 451/555

(Continued)

FOREIGN PATENT DOCUMENTS

EP 2712707 A1 * 4/2014 ..... B24D 15/082
KR 200370469 Y1 * 12/2004 ..... B24B 3/54

*Primary Examiner* — Joel D Crandall
(74) *Attorney, Agent, or Firm* — Stein IP, LLC

(57) ABSTRACT

The present application disclosed an electric knife sharpener for elastically grinding double edges comprises an electric motor, a rotating shaft, a guide cover and a grinding assembly, wherein the rotating shaft is mounted on the electric motor, a driving pin is convexly arranged on the rotating shaft, the grinding assembly comprises two grinding discs, the grinding discs is provided with a sliding shaft sleeve, the sliding shaft sleeve is sleeved on the rotating shaft, and the sliding shaft sleeve is provided with a sliding groove, the driving pin is slidably mounted in the sliding groove; the sliding shaft sleeve is also sleeved with a compression spring; the extending axis of the grinding groove is obliquely arranged with respect to the central axis of the rotating shaft, both cutting edges of the cutter can maintain effective contact with the grinding surface of the grinding disc, eliminating the grinding blind area.

10 Claims, 5 Drawing Sheets

(56) References Cited

U.S. PATENT DOCUMENTS

2013/0295824 A1* 11/2013 Hasegawa ..... B24D 15/082
451/349
2022/0274221 A1* 9/2022 Tsukanov ..... B24B 49/12

* cited by examiner

ELECTRIC KNIFE SHARPENER FOR ELASTICALLY GRINDING DOUBLE EDGES

TECHNICAL FIELD

The present application relates to the field of knife sharpeners, and more particularly, to an electric knife sharpener for elastically grinding double edges.

BACKGROUND ART

At present, most of the electric knife sharpeners on the market only grind one cutting edge one time; conventional kitchen knives are double-edged, and only one edge is ground at a time. After all, the cutter is pulled manually. The difference in skill, weight, etc. between the two grindings will cause the two edges of the ground blade to be asymmetrical, which will affect the sharpness degree of the cutter and low grinding efficiency.

In addition, in the market, a manual knife sharpener is commonly used to simultaneously sharpen double edges, the grinding wheel is fixed, it only can be sharpened at one angle, and the included angle of the cutting edge of the kitchen knife is different, so there is a certain limitation in use.

Finally, the electric knife sharpener on the market needs to fix the knife body with the sharpener notch to achieve the same angle, which may cause plastic friction between the knife body and the notch part and may scratch the knife body and damage the cutter. The notch of the grinding tool is wide, the root and tip of the cutter cannot contact the grinding wheel, which results in the root and tip of the cutter cannot be ground the cut well, and there is a blind zone in the grinding of the cutter.

SUMMARY OF THE INVENTION

The technical problem to be solved by the present application is that an electric knife sharpener for elastically grinding double edges is provided, which can grind both cutting edges of the cutter simultaneously one time, improving the grinding efficiency, the inner grinding wheel is in elastic contact with the cutting edges of the cutter, and protect the cutter. In order to solve the above-mentioned technical problem, the technical solution adopted by the present application is: an electric knife sharpener for elastically grinding double edges, comprising a base, an electric motor, a rotating shaft, a guide cover and a grinding assembly, wherein the electric motor is mounted on the base, the rotating shaft is mounted on the electric motor, a driving pin is convexly arranged on the rotating shaft, the grinding assembly comprises two grinding discs, the grinding surfaces of the two grinding discs are arc-shaped and the grinding surfaces are arranged opposite to each other, one side of the grinding discs facing away from the grinding surfaces thereof is provided with a sliding shaft sleeve, the sliding shaft sleeve is sleeved on the rotating shaft, and the sliding shaft sleeve is provided with a sliding groove extending along the length direction of the rotating shaft, the driving pin is slidably mounted in the sliding groove; a compression spring is further sleeved on the sliding shaft sleeve, and the compression spring is connected to the driving pin; The guide cover is mounted on the base and is covered on the grinding assembly, the guide cover is provided with a grinding groove at a position corresponding to the grinding assembly, the extending axis of the grinding groove is obliquely arranged with respect to the central axis of the rotating shaft, and the grinding surface of one of the grinding discs is exposed at one end of the grinding groove, and the grinding surface of the other grinding disc is exposed at the other end of the grinding groove.

The beneficial effects of the present application are:

1. Simultaneous grinding of both cutting edges of the cutter one time is achieved, doubling the grinding efficiency compared to single grinding of one cutting edge;
2. By arranging the sliding shaft sleeve and the compression spring on the side of the grinding disc facing away from the grinding surface thereof, the elastic contact between the grinding disc and the cutter is realized, and the elastic adjustment can be realized according to the size of the cutting edge, without changing the cutting edge angle of the original cutter, and protecting the cutter;
3. The extending axis of the grinding groove is obliquely arranged with respect to the central axis of the rotating shaft, the grinding surface of one grinding disc is exposed at one end of the grinding groove and the grinding surface of the other grinding disc is exposed at the other end of the grinding groove, so that both cutting edges of the cutter can maintain effective contact with the grinding surface of the grinding disc, eliminating the grinding blind area.

DETAILED DESCRIPTION OF THE INVENTION

Figure 1:
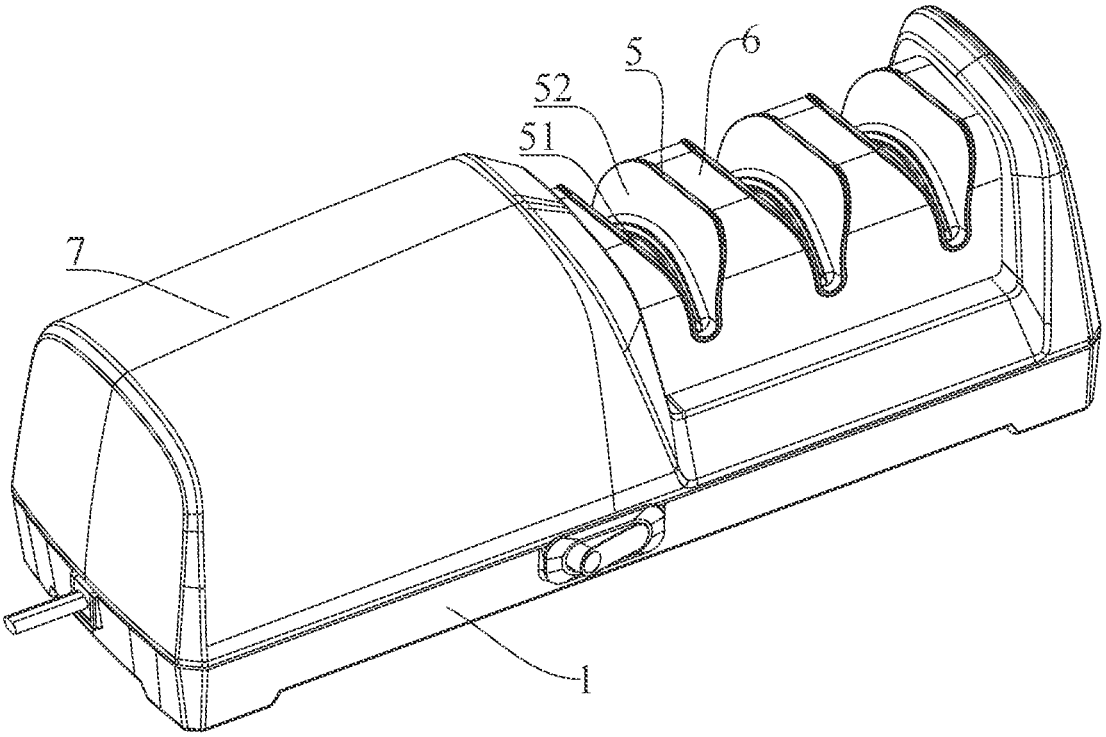
FIG. 1 is a structural schematic view of an electric knife sharpener for elastically grinding double edges according to the first embodiment of the present application.
Figure 2:
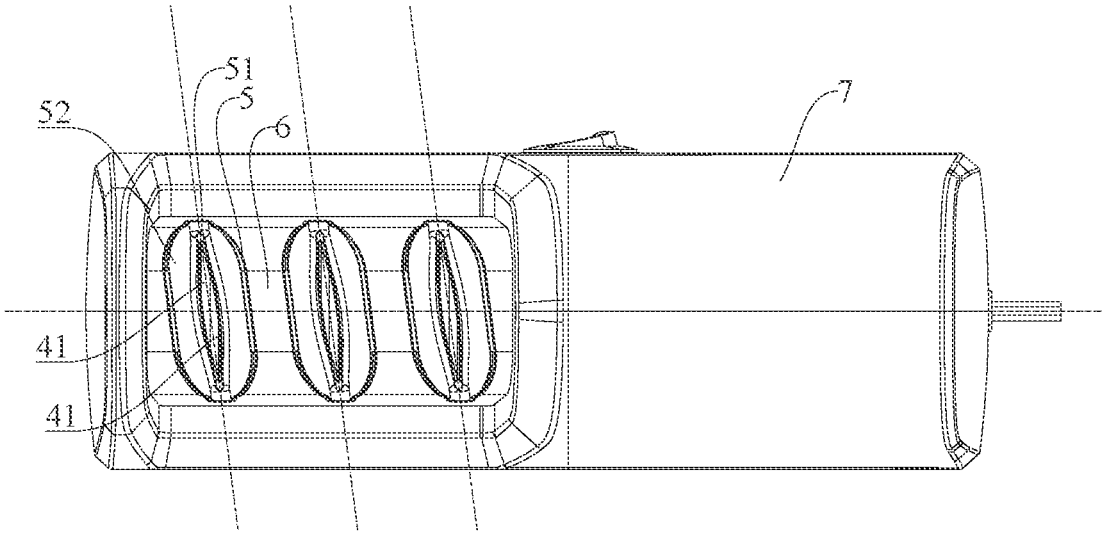
FIG. 2 is a top view of an electric knife sharpener for elastically grinding double edges according to the first embodiment of the present application.

In order to explain the technical contents, the achieved objects, and the effects of the present application in detail, the following description is made in conjunction with the embodiments and the accompanying drawings.

With reference to FIGS. 1 to 6, an electric knife sharpener for elastically grinding double edges, comprising a base 1, an electric motor 2, a rotating shaft 3, a guide cover 4 and a grinding assembly 5, wherein the electric motor 2 is mounted on the base 1, the rotating shaft 3 is mounted on the electric motor 2, a driving pin 31 is convexly arranged on the rotating shaft 3, the grinding assembly 4 comprises two grinding discs 41, the grinding surfaces of the two grinding discs 41 are arc-shaped and the grinding surfaces are arranged opposite to each other, one side of the grinding discs 41 facing away from the grinding surfaces thereof is provided with a sliding shaft sleeve 42, the sliding shaft sleeve 42 is sleeved on the rotating shaft 3, and the sliding shaft sleeve 42 is provided with a sliding groove 421 extending along the length direction of the rotating shaft 3, the driving pin 31 is slidably mounted in the sliding groove 421; a compression spring 43 is also sleeved on the sliding shaft sleeve 42, and the compression spring 43 is connected to the driving pin 31; the guide cover 5 is mounted on the base 1 and is covered on the grinding assembly 4, the guide cover 5 is provided with a grinding groove 51 at a position corresponding to the grinding assembly 4, the extending axis of the grinding groove 51 is obliquely arranged with respect to the central axis of the rotating shaft 3, and the grinding surface of one of the grinding discs 41 is exposed at one end of the grinding groove 51, and the grinding surface of the other grinding disc 41 is exposed at the other end of the grinding groove 51.

It can be seen from the above description that the beneficial effects of the present application are as follows: by arranging the sliding shaft sleeve 42 and the compression spring 43 on the side of the grinding disc 41 facing away from the grinding surface thereof, the elastic contact between the grinding disc 41 and the cutter is realized, and the elastic adjustment can be realized according to the size of the cutting edge, without changing the cutting edge angle of the original and protecting the cutter; the extending axis of the grinding groove 51 is obliquely arranged with respect to the central axis of the rotating shaft 3, and the grinding surface of one grinding disc 41 is exposed at one end of the grinding groove 51 and the grinding surface of the other grinding disc 41 is exposed at the other end of the grinding groove 51, so that both cutting edges of the cutter can maintain effective contact with the grinding surface of the grinding disc 41, eliminating the grinding blind area.

Further, guide cover 5 is further provided with a guide opening 52 in communication with the grinding groove 51.

It can be seen from the above description that the guide opening 52 can guide the cutter to ensure that the cutter can be accurately placed in the grinding groove 51 for grinding, so as to improve the user's experience.

Further, the number of the grinding assemblies 4 is plural, and the number of the grinding grooves 51 is equal to the number of the grinding assemblies 4.

It can be seen from the above-mentioned description that the provision of multiple sets of grinding assemblies 4 can grind multiple cutters at the same time, improving the grinding efficiency; It is also possible to combine the grinding assemblies 4 with different grinding parameters according to actual application requirements, so as to realize multi-stage grinding. Further, a decorative sheet 6 is further installed on an outer side of the guide cover 5, and the decorative sheet 6 is provided with an avoidance hole 61 at a position facing the grinding groove 51.

It can be seen from the above-mentioned description that decorative sheet 6 can decorate the guide cover 5 and can also play a protective role for the guide cover 5.

Further, the bottom of the base 1 is provided with a waste discharge port 12 at a position corresponding to the grinding assembly 4.

As can be seen from the above description, the waste discharge port 12 facilitates the discharge of scrap generated during the grinding of the cutter.

Further, the base 1 is provided with a waste collection box 9 at a position facing the waste discharge port 12, and the waste collection box 9 is detachably connected to the base 1.

As can be seen from the above description, the waste collection box 9 facilitates the collection of scrap debris for uniform cleaning of the scrap debris.

Further, a magnetic attraction piece is provided in the waste collection box 9.

As can be seen from the above description, the magnetic attraction piece can attract the scrap, ensuring that the scrap falls efficiently into the waste collection box 9 and preventing the scrap from splashing.

Furthermore, the base 1 is provided with a heat dissipation hole 11 at a position corresponding to the electric motor 2.

It can be seen from the above-mentioned description that the heat dissipation hole 11 facilitates heat dissipation of the electric motor 2, avoids overheating of the electric motor 2, and ensures the stability of the operation of the electric motor 2.

Further, the bottom of the base 1 is provided with an anti-skid pad 8.

As apparent from the above description, the anti-skid pad 8 can prevent the base 1 from slipping.

Further, an upper cover 7 is provided, the upper cover 7 is connected to the base 1 and forms a receiving space with the base 1, and the electric motor 2 is installed in the receiving space. It can be seen from the above description that the upper cover 7 facilitates shielding the electric motor 2.

Example 1

Figure 5:
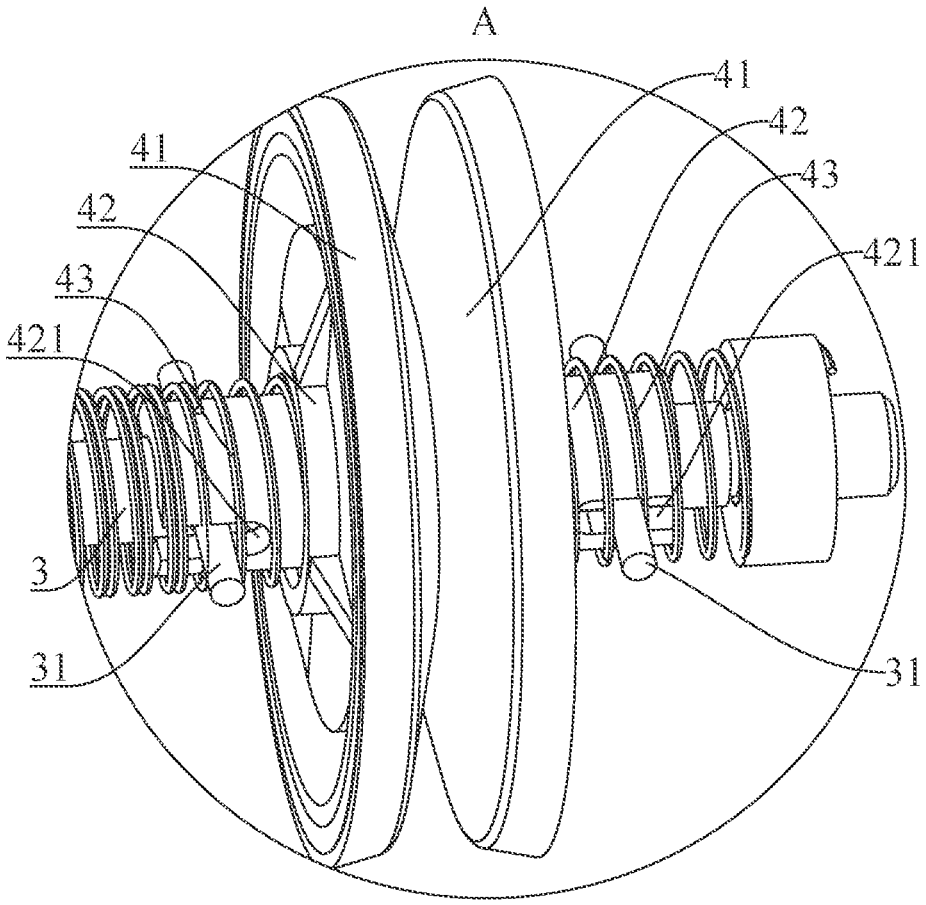
FIG. 5 is a detailed view at A in FIG. 4.
Figure 6:
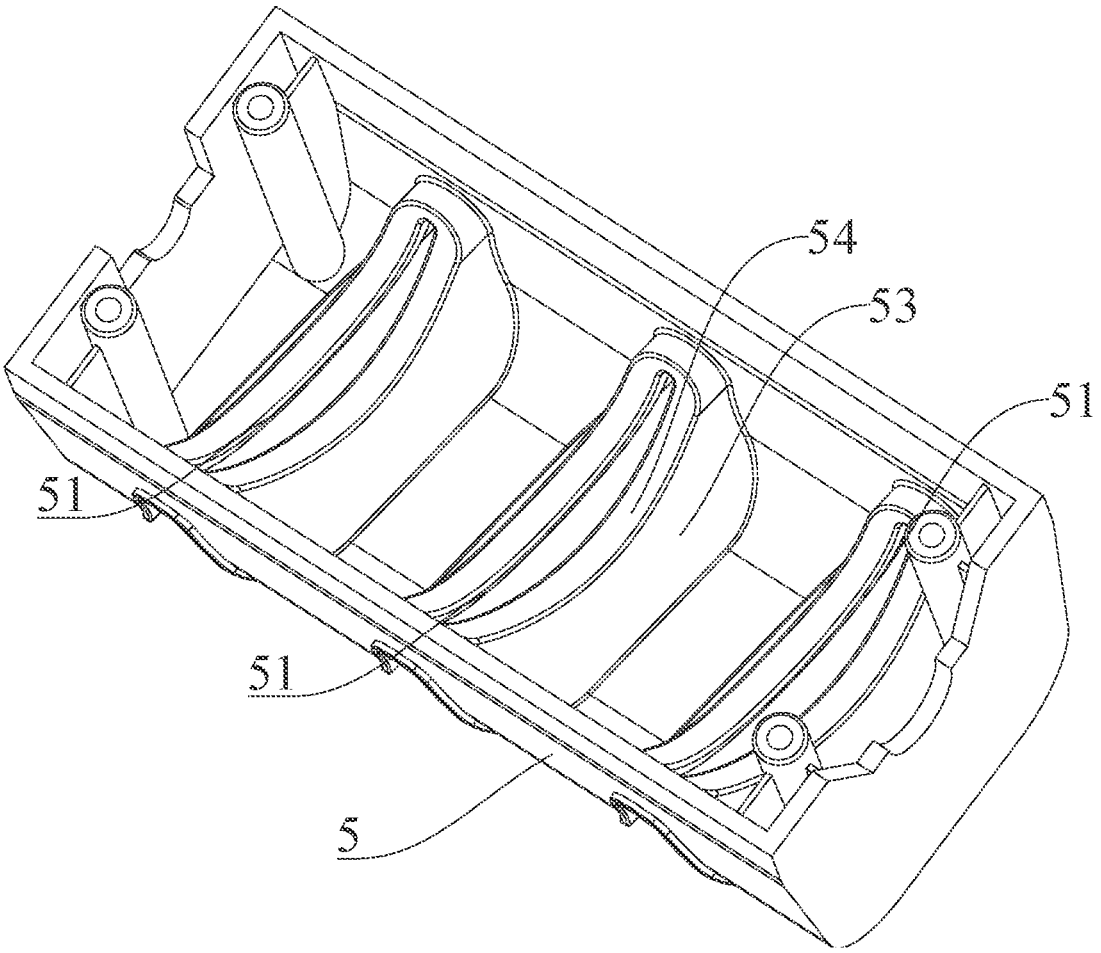
FIG. 6 is a structural schematic view of a guide cover of an electric knife sharpener for elastically grinding double edges according to the first embodiment of the present application.

With reference to FIGS. 1 to 5, the first embodiment of the present application is: an electric knife sharpener for elastically grinding double edges, comprising a base 1, an electric motor 2, a rotating shaft 3, a guide cover 5, a grinding assembly 4 and an upper cover 7, wherein the electric motor 2 is mounted on the base 1, the upper cover 7 is connected to the base 1 and forms an accommodating space with the base 1, the electric motor 2 is mounted on the accommodating space, the rotating shaft 3 is mounted on the electric motor 2, a driving pin 31 is convexly arranged on the rotating shaft 3, please refer to FIG. 5, the grinding assembly 4 comprises two grinding discs 41, the grinding surfaces of the two grinding discs 41 are in the shape of an arc surface, and the grinding surfaces are arranged opposite to each other; a sliding shaft sleeve 42 is provided on one side of the grinding disc 41 facing away from the grinding surface thereof, the sliding shaft sleeve 42 is sleeved on the rotating shaft 3, the sliding shaft sleeve 42 is provided with a sliding groove 421 extending along the length direction of the rotating shaft 3, and the driving pin 31 can be slidably mounted on the sliding groove 421; a compression spring 43 is also sleeved on the sliding shaft sleeve 42, and the compression spring 43 is connected to the driving pin 31; The guide cover 5 is mounted on the base 1 and is covered on the grinding assembly 4, and the guide cover 5 is provided with a grinding groove 51 at a position corresponding to the grinding assembly 4; please combine FIGS. 2 and 3, the extending axis of the grinding groove 51 is obliquely arranged with respect to the central axis of the rotating shaft 3, that is to say, projecting along the height direction of the electric knife sharpener for elastically grinding double edges, the central axis of the extending direction of the grinding groove 51 and the central axis of the rotating shaft 3 are distributed at an included angle, the included angle ranges from 0° to 90°, and the degree of the included angle is preferably 75°; The grinding surface of one of the grinding discs 41 is exposed to one end of the grinding groove 51, and the grinding surface of the other grinding disc 41 is exposed to the other end of the grinding groove 51; in detail, the inner side of the guide cover 5 is formed with an arc-shaped space (as shown in FIG. 6) at a position corresponding to the grinding groove 51; it should be noted that a boss 53 is convexly provided on the inner side of the guide cover 5, an arc-shaped groove 54 is provided on the boss 53, and the grinding groove 51 is in communication with the arc-shaped groove 54; the arc-shaped space refers to a partial space removed on the boss 53 for forming the arc-shaped groove 54, and partial areas of both the grinding discs 41 are located in the arc-shaped space, and more specifically, the volume proportion of both the grinding discs 41 in the arc-shaped space is 65% to 75%; it can be understood that by arranging the sliding shaft sleeve 42 and the compression spring 43 on the side of the grinding disc 41 facing away from the grinding surface thereof, the elastic contact between the grinding disc 41 and the cutter is realized, and the elastic adjustment can be realized according to the size of the cutting edge, without changing the cutting edge angle of the original cutter, and protecting the cutter; the extending axis of the grinding groove 51 is obliquely arranged with respect to the central axis of the rotating shaft 3, and the grinding surface of one grinding disc 41 is exposed at one end of the grinding groove 51 and the grinding surface of the other grinding disc 41 is exposed at the other end of the grinding groove 51, so that both cutting edges of the cutter can maintain effective contact with the grinding surface of the grinding disc 41, eliminating the grinding blind area.

Preferably, the guide cover 5 is further provided with a guide opening 52 in communication with the grinding groove 51, wherein the guide opening 52 can guide the cutter to ensure that the cutter can be accurately placed into the grinding groove 51 for grinding, so as to facilitate the improvement of user experience; Specifically, a decorative sheet 6 is further installed an outer side of the guide housing 5, and the decorative sheet 6 is provided with an avoidance hole 61 at a position facing the grinding groove 51, and the decorative sheet 6 can decorate the guide cover 5 and can also play a protective role for the guide cover 5.

As an option, the number of the grinding assemblies 4 is multiple, and the number of the grinding grooves 51 is equal to the number of the grinding assemblies 4, it can be understood that the provision of multiple groups of grinding assemblies 4 can grind multiple cutters at the same time, improving the grinding efficiency; Furthermore, the grinding assembly 4 with different grinding parameters can also be selected and combined according to actual application requirements so as to realize multi-stage grinding; Furthermore, since the extending axis of the grinding groove 51 is obliquely arranged with respect to the central axis of the rotating shaft 3, it is ensured that multiple groups of the grinding assemblies 4 can be mounted on the same rotating shaft 3 to achieve multi-stage synchronous grinding; Alternatively, the grinding surface of the grinding disc 41 is made of a diamond abrasive, and the mesh number of the grinding surface formed by the diamond abrasive may be 360 mesh, 600 mesh or 1000 mesh; In particular, in the present embodiment, the number of the grinding assemblies 4 is three groups, wherein the roughness of the grinding discs 41 used in each group of the grinding assemblies 4 is different; In detail, referring to FIG. 4, from left to right, the grinding surface of the grinding disc 41 of the grinding assembly 4 of the first group is made of 360 mesh diamond abrasive, the grinding surface of the grinding disc 41 of the grinding assembly 4 of the second group is made of 600 mesh diamond abrasive, and the grinding surface of the grinding disc 41 of the grinding assembly 4 of the third group is made of 1000 mesh diamond abrasive.

Figure 3:
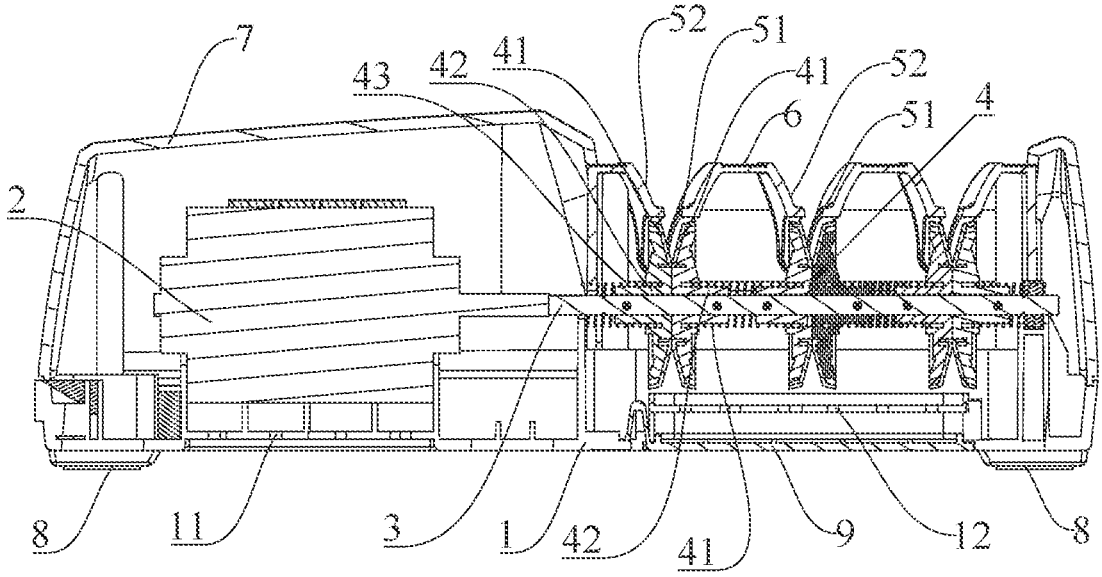
FIG. 3 is a cross-sectional structural schematic view of an electric knife sharpener for elastically grinding double edges according to the first embodiment of the present application.
Figure 4:
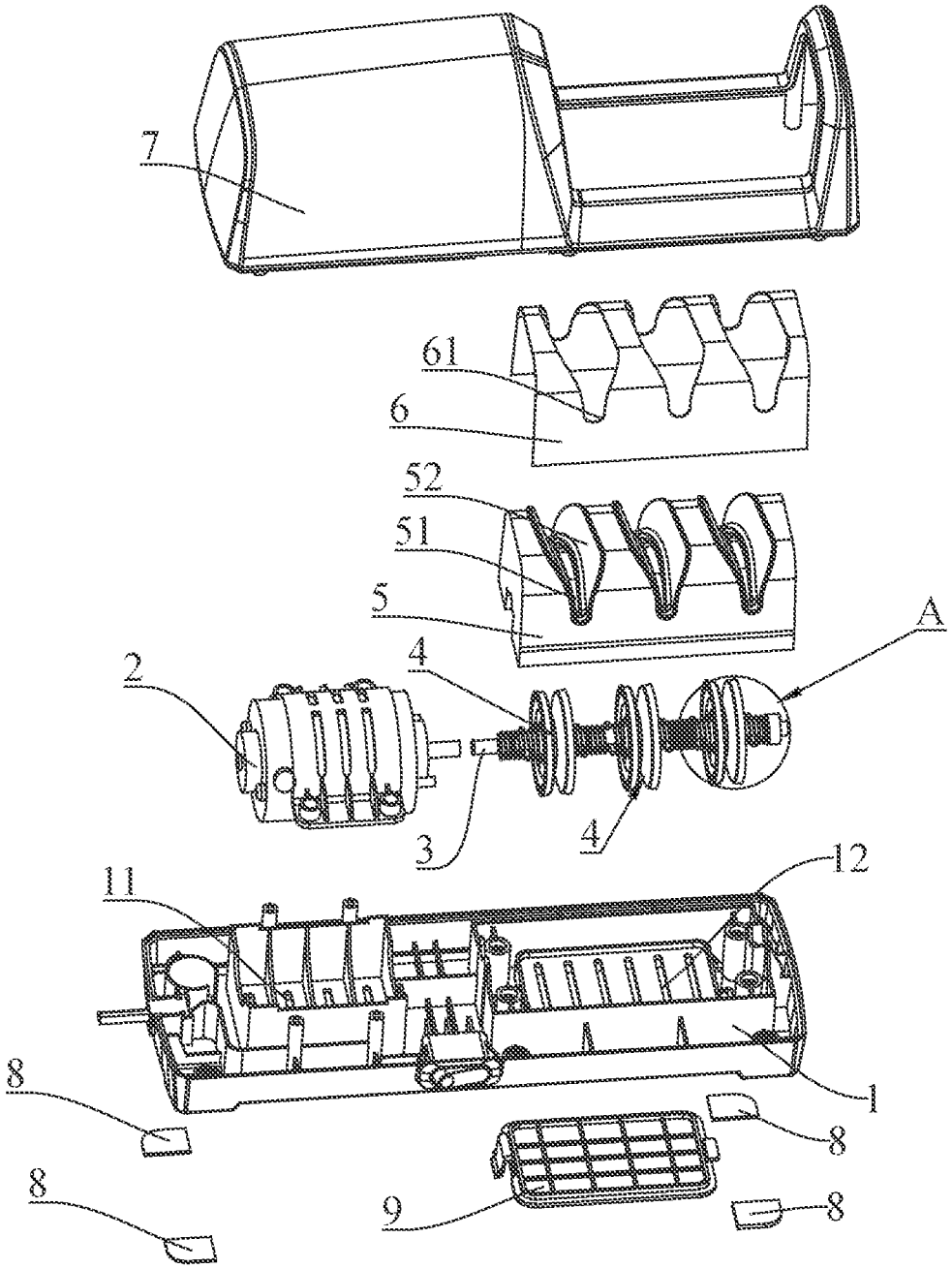
FIG. 4 is an exploded view of an electric knife sharpener for elastically grinding double edges according to the first embodiment of the present application.

Preferably, referring to FIG. 3, the bottom of the base 1 is provided with a waste discharge port 12 at a position corresponding to the grinding assembly 4, and the waste discharge port 12 facilitates the discharge of the scrap generated during the grinding process of the cutter; Specifically, the base 1 is provided with a waste collection box 9 at a position facing the waste discharge port 12, the waste collection box 9 is detachably connected to the base 1, and the waste collection box 9 is convenient for collecting the scrap waste so as to uniformly clean the scrap waste; In detail, the waste collection box 9 is provided with a snap-fastener for connecting with the base 1, and the disassembly and assembly of the waste collection box 9 is realized by the snap-fastening with the bottom of the base 1; in addition, the detachable connection can also be a screw connection, a bolt connection or a magnetic suction connection; It can be specifically set according to actual application requirements; Alternatively, a magnetic attraction piece (not shown) may be provided in the waste collection box 9, the magnetic attraction piece is a magnet and capable of attracting the scrap waste, ensuring that the scrap waste can effectively fall into the waste collection box 9, and preventing the scrap waste from splashing.

In the present embodiment, the base 1 is provided with a heat dissipation hole 11 at a position corresponding to the electric motor 2, and the heat dissipation hole 11 facilitates heat dissipation of the electric motor 2, avoids overheating of the electric motor 2, and ensures the stability of the operation of the electric motor 2; the bottom of the base 1 is further provided with an anti-skid pad 8 capable of preventing the base 1 from slipping; The material of the anti-skid pad 8 is flexible, and the flexible material includes but is not limited to sponge, rubber, silica gel, etc.

In summary, the present application provides that by arranging the sliding shaft sleeve and the compression spring on the side of the grinding disc facing away from the grinding surface thereof, the elastic contact between the grinding disc and the cutter is realized, and the elastic adjustment can be realized according to the size of the cutting edge, without changing the cutting edge angle of the original cutter, and protecting the cutter; the extending axis of the grinding groove is obliquely arranged with respect to the central axis of the rotating shaft, and the grinding surface of one grinding disc is exposed at one end of the grinding groove and the grinding surface of the other grinding disc is exposed at the other end of the grinding groove, so that both cutting edges of the cutter can maintain effective contact with the grinding surface of the grinding disc, eliminating the grinding blind area; The magnetic attraction piece adsorbs the scrap waste, ensures that the scrap waste effectively falls into the waste collection box, and prevents the scrap waste from splashing.

The above-mentioned embodiments are merely examples of the present application and are not intended to limit the scope of the present application, and all changes that come within the meaning and range of equivalency of the present application and the appended claims are to be embraced within their scope.

The invention claimed is:

1. An electric knife sharpener for elastically grinding double edges, comprising:

a base;

an electric motor;

a rotating shaft;

a guide cover; and a grinding assembly, wherein the electric motor is mounted on the base, the rotating shaft is mounted on the electric motor, a driving pin is radially arranged on the rotating shaft, the grinding assembly comprises two grinding discs, the grinding surfaces of the two grinding discs are arc-shaped and the grinding surfaces are arranged opposite to each other, one side of the grinding discs facing away from the grinding surfaces thereof is provided with a sliding shaft sleeve, the sliding shaft sleeve is sleeved on the rotating shaft, and the sliding shaft sleeve is provided with a sliding groove extending along the length direction of the rotating shaft, the driving pin is slidably mounted in the sliding groove; a compression spring is further sleeved on the sliding shaft sleeve, and the compression spring is connected to the driving pin to rotate together with the rotating shaft, the driving pin and the grinding discs; the guide cover is mounted on the base and covers the grinding assembly, the guide cover is provided with a grinding groove at a position corresponding to the grinding assembly, the extending axis of the grinding groove is obliquely arranged with respect to the central axis of the rotating shaft, and the grinding surface of one of the grinding discs is exposed at one end of the grinding groove, and the grinding surface of the other grinding disc is exposed at the other end of the grinding groove; the inner side of the guide cover is formed with an arc-shaped space at a position corresponding to the grinding groove, and the volume ratio of the two grinding discs in the arc-shaped space is 65% to 75%.

2. The electric knife sharpener for elastically grinding double edges of claim 1, wherein the guide cover is further provided with a guide opening in communication with the grinding groove.

3. The electric knife sharpener for elastically grinding double edges of claim 1, wherein the number of grinding assemblies is multiple and the number of grinding grooves is equal to the number of grinding assemblies.

4. The electric knife sharpener for elastically grinding double edges of claim 3, wherein the grinding surfaces of the grinding discs are made of diamond abrasive.

5. The electric knife sharpener for elastically grinding double edges of claim 4, wherein the grinding surfaces of the grinding discs of at least one set of the grinding assemblies have a mesh number of 360 mesh.

6. The electric knife sharpener for elastically grinding double edges of claim 4, wherein the grinding surfaces of the grinding discs of at least one set of the grinding assemblies have a mesh number of 600 mesh.

7. The electric knife sharpener for elastically grinding double edges of claim 4, wherein the grinding surfaces of the grinding discs of at least one set of the grinding assemblies have a mesh number of 1000 mesh.

8. The electric knife sharpener for elastically grinding double edges of claim 1, wherein a sheet is further installed on an outer side of the guide cover, and the sheet is provided with an avoidance hole at a position facing the grinding groove.

9. The electric knife sharpener for elastically grinding double edges of claim 1, wherein the central axis of the extending direction of the grinding groove and the central axis of the rotating shaft are distributed at an included angle, as projected along the vertical direction of the electric knife sharpener, the included angle ranges from 0° to 90°.

10. The electric knife sharpener for elastically grinding double edges of claim 9, wherein the included angle is in degrees of 75°.

* * * * *